United States Patent [19]

Shie

[11] Patent Number: 5,060,331

[45] Date of Patent: Oct. 29, 1991

[54] METHOD OF PRODUCING WING NUTS

[75] Inventor: Tsai-Fu Shie, Tainan, Taiwan

[73] Assignee: Luchu Shinyee Works Co., Ltd., Luchu Kaohsiung, Taiwan

[21] Appl. No.: 631,412

[22] Filed: Dec. 21, 1990

[51] Int. Cl.[5] ..... B21D 53/20; B21D 53/24

[52] U.S. Cl. ..... 10/86 W

[58] Field of Search ..... 10/86 R, 86 W; 411/435

[56] References Cited

U.S. PATENT DOCUMENTS 1,391,792 9/1921 Recker ..... 10/86 W 2,068,076 1/1937 Rosenberg ..... 10/86 W 2,714,450 9/1950 Chestnut ..... 10/86 W

FOREIGN PATENT DOCUMENTS 7127856 5/1968 Japan ..... 10/86 W

*Primary Examiner*—Lowell A. Larson

*Assistant Examiner*—Michael J. McKeon

*Attorney, Agent, or Firm*—Morton J. Rosenberg; David I. Klein

[57] ABSTRACT

An improved method to produce wing nut. The wing nuts being produced through a sequence of operations comprising cutting, trimming, upsetting, bending, extrusion, drilling, wing forming and tapping.

2 Claims, 5 Drawing Sheets

CUTTING

↓

TRIMMING

↓

UPSETTING

↓

UPSETTING

↓

BENDING

↓

EXTRUSION

↓

EXTRUSION

↓

DRILLING

↓

WING FORMING

↓

TAPPING

FIG. 1

METHOD OF PRODUCING WING NUTS

BACKGROUND OF THE INVENTION

Nuts and bolts have become one of the most important fasteners to connect two or more parts together, and are made in many different shapes to suit different purposes. The most common nuts are those known as hex nuts, jam nuts or square nuts. If the purpose of nut is to provide a connection, but does not require a great connecting force, then a wing nut is one of the most convenient to use. A wing nut is easily tightened or loosened from a bolt, and can be applied in many applications such as for the positive or negative post of a battery, TV antenna connections or in foldable bicycles. The present products on the market are produced by either a compression forming method or by casting. For both of these two methods problems exist which need to be corrected. For instance, wing nuts formed by the compression method (as shown in FIG. 5*a*) have the following problems: 1. they are formed of a thin raw material which easily cracks during tapping, 2. they are not of a solid formation and easily oxygenate and corrode, 3. they have a granular leading edge formed during manufacturing, and 4. there is waste of material during the manufacturing process. The casting method (as shown in FIG. 5*b*) produces wing nuts with the following problems: 1. they have a rough and an uneven surface that will lower their quality feeling and will accidentally injure people or parts, and, 2. are formed with a stress force which may cause the product to crack.

In view of these shortcomings, an improved method of producing wing nuts that produces a wing nut which is solid and has a smooth surface is provided.

SUMMARY OF THE INVENTION

It is the primary object of the present invention to provide a method to produce wing nuts which increases the production line speed.

It is another object of the present invention to provide a method to produce wing nuts which systemizes the production line.

It is still another object of the present invention to provide a method to produce wing nuts which provides a more secure fastener for goods.

BRIEF DESCRIPTION OF THE DRAWINGS

FIG. 1 is a block diagram of the present invention;

DETAILED DESCRIPTION OF THE PREFERRED EMBODIMENT

Figure 2:
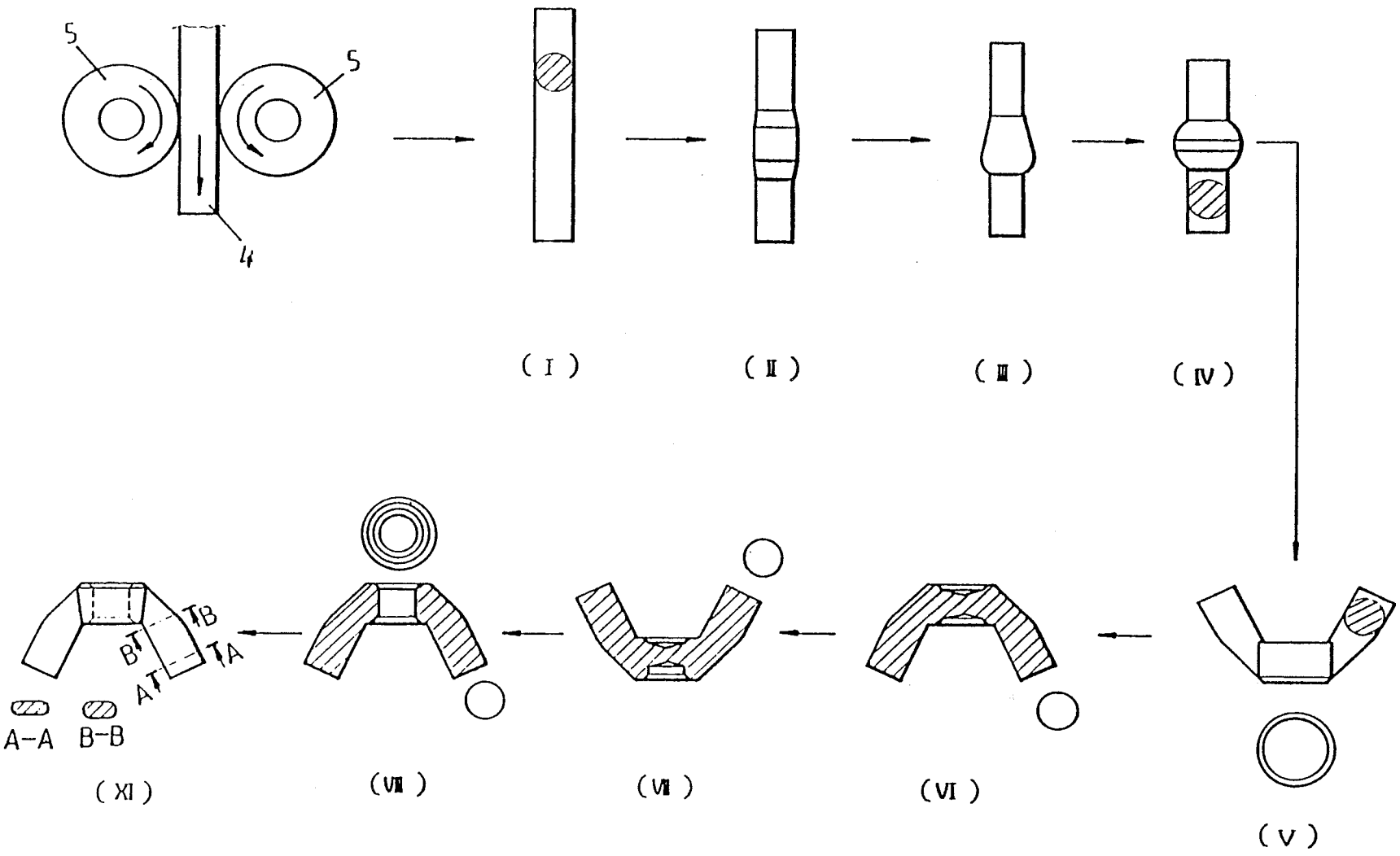
FIG. 2 is a flow chart of the production line of the present invention.

Referring now to FIGS. 1 and 2, there is shown the present invention process, comprising steps of cutting, trimming, upsettings, bending, extruding, drilling, wing forming and tapping. The above-mentioned procedures are all performed by a wing nut forging machine which has the ability to feed and clamp raw material and semi-finished product during the process. The feeding of the raw material is accomplished with a cam, an arm, a ratchet and a conveying gear. The cam drives the ratchet to rotate, such that as the ratchet rotates a step of angle $\theta$, the conveying gear will rotate through the same angle $\theta$, and starts to feed the material at every $2\pi/\theta$ degrees of rotation. Assuming "D" is tangent to the conveying gear, the feeding length shall be $\pi D \div (2\pi/\theta) = D\theta/2$. If the volume of every wing nut is "V", the diameter of raw material is "d", and the feeding length is "L", then the volume $V = (\pi d^2/4) \times L$ and therefore, $L = 4V/\pi d^2$. Since the feeding length $D\theta/2$ equals $4V/\pi d^2$, then $\theta = 8V/\pi d^2 D$. It is therefore seen that by adjusting the rotation angle $\theta$, the feeding can be precisely controlled.

Figure 3C:
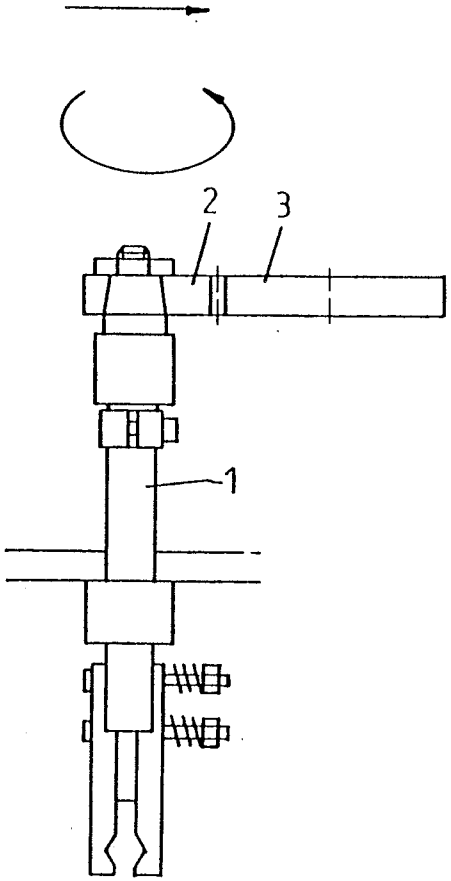
FIG. 3*c* is a side view of a spinning clamp.
Figure 3B:
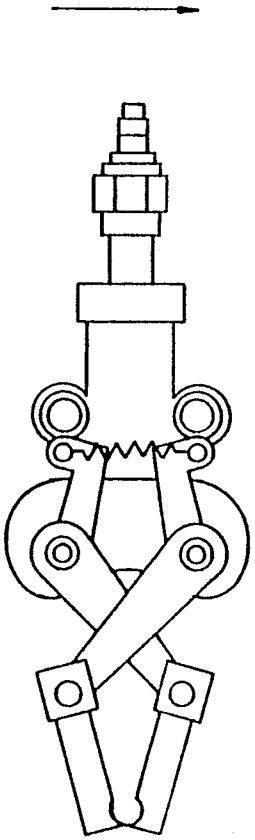
FIG. 3*b* is a front view of a horizontal conveying clamp.
Figure 3A:
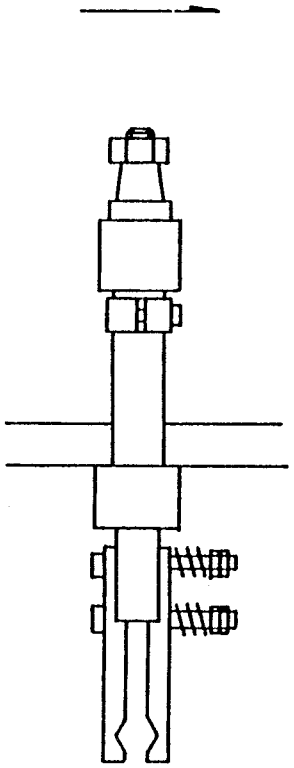
FIG. 3*a* is a side view of a horizontal conveying clamp.

The auto clamp contains two clamps, one is a horizontal clamp, and the other is a spinning clamp. The horizontal clamp clamps raw material and conveys it from each process step to the next (shown in FIGS. 3*a* and 3*b*). The spinning clamp clamps and turns the material in 90 or 180 degree increments for processing. The spinning clamp, shown in FIG. 3*c*, consists of a center shaft 1 having a satellite gear 2 which is engaged with a center gear 3. When the clamp is moving, the satellite gear 2 is rotated simultaneously, which drives the clamp to rotate to a predetermined angle, by engaging with different gears, the spinning clamp is rotated in 90 or 180 degree increments.

Figure 4:
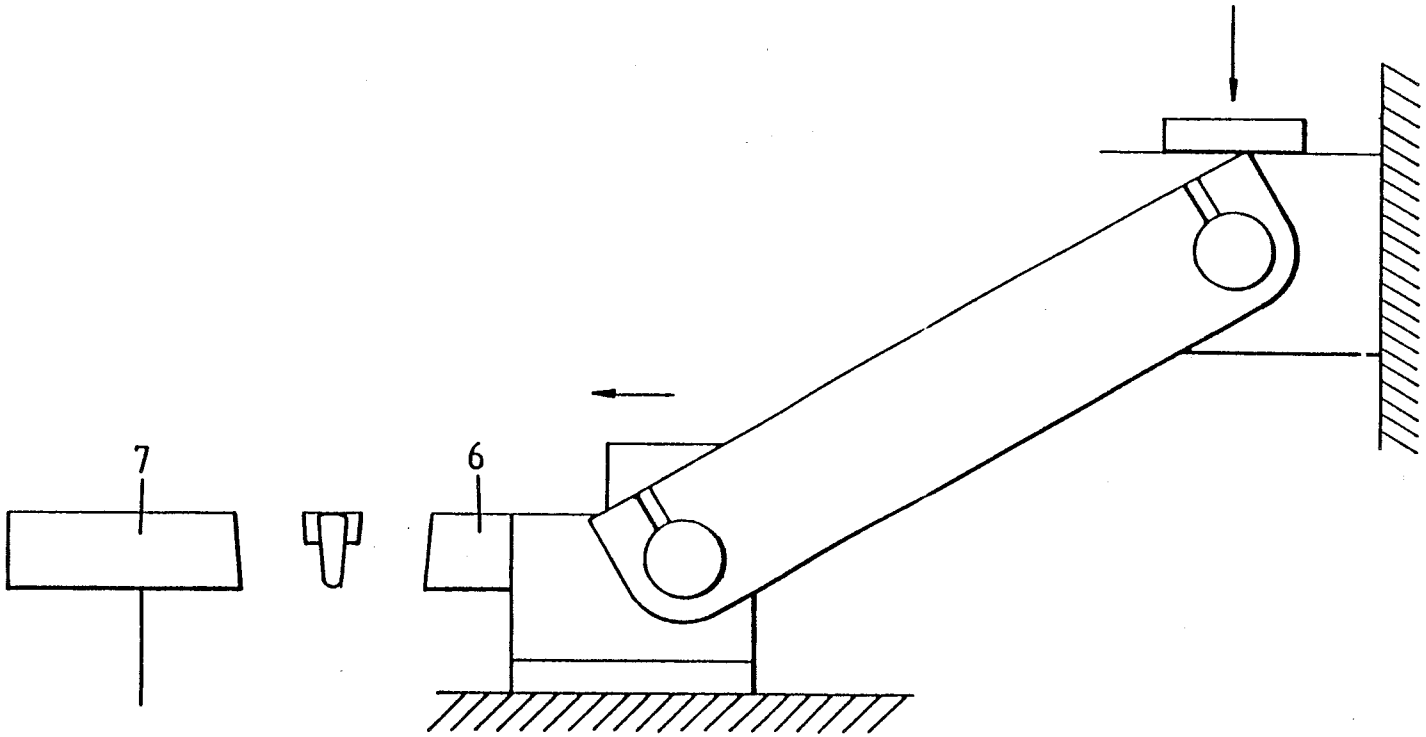
FIG. 4 is a enlarged side view of wing making of FIG. 1.
Figure 5A:
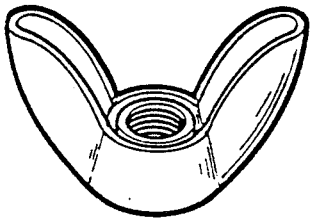
FIG. 5a Prior Art
FIG. 5*a* is a prior art wing nut formed by the compression method.
Figure 5B:
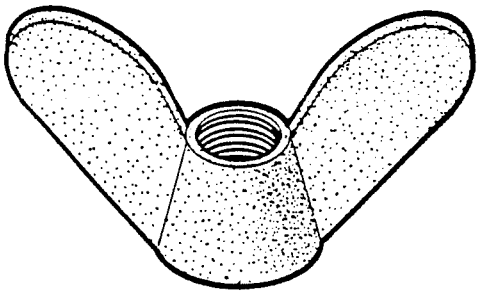
FIG. 5b Prior Art
FIG. 5*b* is a prior art wing nut formed by the casting method.

The cutting of the raw material is the first step of the inventive method (as shown in FIGS. 1 and 2). The raw material is cut with a shearing die, which hears the material to the required length, and conveys it to the trimming step. The trimming operation trims the two ends of the cut material evenly and conveys the material to upsetting operation which requires two steps to upset the center portion of the raw material into cylindrical shape, the first step flattening the center portion. The bending process is next, wherein the two ends of the raw material, which has been 90 degrees, are bent upward and the center portion is forged into a flat round shape. The nut, now in the basic shape of a wing nut, is rotated 180 degrees and conveyed to the extrusion step, which presses the center portion into an inverted cone shape, and forges two opposing indented areas, one at the top and the other at the bottom. The basic shaped wing nut is then rotated another 180 degrees and conveyed to the next extrusion step, which makes the two indented areas deeper. The part is then conveyed to the drilling step, where the center portion is drilled to form a hole therethrough, and then conveyed to the wing forming operation. The wing forming operation uses a press machine to form the two wings (as shown in FIG. 4). The press machine comprises a movable die controlled by a sliding block and fixed die. The two dies both have an inclined pressing surface that will form the body of the two wings to be gradually thinner towards the upmost portion. The wing nut is then conveyed to the tapping step where the hole is threaded with an internal screw thread. As can be seen, all of the above-mentioned operations are done in a series of processes, and comprise the following advantages, (1) eliminating material waste, (2) automation processing, (3) improved quality, (4) long lasting usage, and (5) the products have no burr at their edges.

I claim:

1. An improved method of manufacturing wing nuts, comprising:

a. precisely cutting a predetermined length of raw material;

b. evenly trimming opposing ends of said cut length of said raw material;

c. a first upsetting step for flattening a center portion of said cut length;

d. a second upsetting step for forming said flattened portion into a substantially cylindrical contour having a pair of opposing end surfaces;

e. a bending step for displacing opposing ends of said cut length in a direction substantially othoginal a plane defined by either of said pair of opposing end surfaces;

f. a first forging step for further shaping said center portion and forming an indentation of a predetermined depth in each of said pair of opposing end surfaces;

g. a second forging step for increasing said depth of said indentations;

h. forming a through opening extending between said indentations formed in said pair of opposing end surfaces;

i. pressing said displaced opposing ends of said cut length to form wing members of said wing nuts in a press machine; and, j. tapping said through opening.

2. The improved method of manufacturing wing nuts as recited in claim 1 where said press machine includes a movable die and a fixed die, both said dies having an inclined pressing surface.

* * * * *